United States Patent [19]

Ishikawa et al.

[11] 4,403,027

[45] Sep. 6, 1983

[54] TONER COMPLEXES FOR DEVELOPING ELECTROSTATIC IMAGES

[75] Inventors: Kazuhiro Ishikawa, Nara; Yoji Kawagishi, Yawata; Yukihiko Ishida, Neyagawa, all of Japan

[73] Assignee: Orient Chemical Industries, Ltd., Japan

[21] Appl. No.: 332,186

[22] Filed: Dec. 18, 1981

[30] Foreign Application Priority Data

Dec. 27, 1980 [JP] Japan ..... 55-186993

[51] Int. Cl.[3] ..... G03G 9/08

[52] U.S. Cl. ..... 430/110; 430/137

[58] Field of Search ..... 430/106, 109, 110, 137

[56] References Cited

U.S. PATENT DOCUMENTS 3,165,420 1/1965 Tomanek et al. ..... 430/106

3,915,874 10/1975 Machida ..... 430/106

*Primary Examiner*—John E. Kittle

*Assistant Examiner*—John L. Goodrow

*Attorney, Agent, or Firm*—McGlew and Tuttle

[57] ABSTRACT

A complex system for developing electrostatic images, and particularly a toner which comprises 100 parts by weight of a resin and for instance 0.5 to 5 parts by weight of the complex system, such as a metal complex of an aromatic dicarboxylic acid which is capable of forming an acid anhydride or of a substituted such aromatic dicarboxylic acid.

35 Claims, No Drawings

TONER COMPLEXES FOR DEVELOPING ELECTROSTATIC IMAGES

FIELD AND BACKGROUND OF THE INVENTION

The present invention relates to novel toner agents in general and, in particular, to metal-containing complexes, e.g. with aromatic dicarboxylic acids, usable in toners for developing electrostatic images in electrophotography, electrostatic recording, electrostatic printing, etc.

Conventional processes for converting latent electrostatic images to visible images are generally divided into two groups: liquid developing processes which use a developer comprising an electrically insulating liquid and a finely divided toner dispersed therein, and dry developing processes, such as the cascade process, fur brush process, magnetic brush process and powder-cloud process, in which a finely divided toner prepared by dispersing a coloring agent in a natural or synthetic resin is used singly or admixed with a solid carrier. The toners useful for such processes are charged positively or negatively in accordance with the polarity of the latent electrostatic image to be developed.

The toner can be made to retain electric charges by utilizing the triboelectric properties of the resin component of the toner, but since the toner is not highly chargeable by this method, the toner image obtained by development is prone to fogging and, in turn, to being obscure. To give the desired triboelectric properties to the toner, dyes and pigments for affording enhanced chargeability and furthermore charge control agents (triboelectrification control agents) are added to the toner. Presently used in the art for this purpose are oil-soluble nigrosine dyes for positively charging toners as disclosed in Published Examined Japanese Patent Application No. 2727/1966, and metal-containing complex dyes for negatively charging toners as disclosed in Published Examined Japanese Patent Application No. 26478/1970.

However, such dyes and pigments serving as charge control agents are complex in structure and have low stability. For example, they decompose or deteriorate when subjected to mechanical friction and impact, variations in temperature and humidity conditions, electric impact, irradiation with light, etc. or they decompose at about 150° C. when kneaded with a melt. Thus, these known dyes and pigments, because of their low stability, are liable to lose their charge controlling properties.

Furthermore, many of these known dyes and pigments have low compatibility with the resin component of the toner, and are therefore difficult to disperse uniformly in the toner and tend to permit uneven charging, with the result that fog occurs in the developed toner image to obscure the image. Moreover, even when the developer exhibits satisfactory developing characteristics in the initial stage of use, the dye or pigment has the drawback of becoming decomposed or of deteriorating with the increase in the number of copying cycles, ultimately rendering the toner no longer serviceable for its contemplated use.

Additionally, one of the substantial drawbacks of conventional dyes or pigments for controlling charges or imparting chargeability is that they are themselves colored materials. This is in conflict with the basic requirement that charge control agents or chargeability imparting agents which are colorless or have a pale color that can be regarded as substantially colorless must be used for toners having a specific color. Recently published Unexamined Japanese Patent Application No. 127726/1978 discloses a metal complex or salicylic acid or alkylsalicylic acid as material fulfilling the aforesaid basic requirement, but it is impossible to knead fully this material with a melt of the resin component of the toner at a high temperature sufficient to dissolve or disperse the material uniformly therein since this metal complex material has an unfortunately low thermal stability.

SUMMARY OF THE INVENTION

In connection with intensive research, which has been conducted on compounds useable in toners of the foregoing general type, but which have high thermal stability and good compatibility with the corresponding resin component, which can be regarded as substantially colorless and which are capable of negatively charging such toners, it has been advantageously found in accordance with the present invention that a metal complex of an aromatic dicarboxylic acid which will form an acid anhydride or an aromatic dicarboxylic acid having a substituent, in other words, a metal complex compound of an aromatic dicarboxylic acid which will form, or more particularly wich is capable of forming, an acid anhydride and which may also have a substituent, exhibits improved properties.

More specifically, such metal containing complex according to the present invention not only is comparable to conventional metal-containing complex dyes in charge controlling performance, but also more importantly is thermally so stable as to be fully kneadable with a melt of the resin component of the toner. Thus, be metal-containing complex compound according to the present invention is useful as a charge control agent for providing toners having high durability and comprising chargeable particles of uniform quality, and of course is fully compatible with the corresponding resin component of the toner and does not impair the charging properties of any attendant conventional coloring agents such as metal-containing complex dyes.

Accordingly, it is among the objects and advantages of the present invention to provide metal-containing complex compounds of improved or high thermal stability, and which are usable in toners for developing electrostatic images in electrophotography, electrostatic recording, electrostatic printing, and the like, and especially toners containing such metal-containing compounds, in which the metal-containing complex compounds not only possess such markedly improved or high thermal stability but also are favorably comparable to conventional metal-containing complex dyes in charge controlling performance, and in particular are at the same time so stable thermally as to be fully kneadable with a melt of the resin component of the toner.

It is among the additional objects and advantages of the present invention to provide such improved or high thermal stability metal-containing complex compounds as useful charge control agents for attaining toners having high durability and comprising chargeable particles of uniform quality, and especially as more or less substantially colorless constituents, which are fully compatible with the corresponding resin component of the toners as well as capable of negatively charging the corresponding toners, all without impairing the charging properties of conventional metal-containing complex dyes usable in association therewith.

Other and further objects of the present invention will become apparent from a study of the within specification and accompanying examples.

The various features of novelty which characterize the invention are pointed out with particularity in the claims annexed to and forming a part of this disclosure. For a better understanding of the invention, its operating advantages and specific objects attained by its uses and inherent features, reference is made to the accompanying descriptive matter in which preferred embodiments of the invention are illustrated.

DESCRIPTION OF THE PREFERRED EMBODIMENTS

According to the present invention, examples of useful aromatic dicarboxylic acids which will form an acid anhydride, i.e. which are capable of forming the corresponding acid anhydride, and which may have a substituent or substitutes, i.e. optionally substituted with one or more substituents on the aromatic nuclear moiety of such acids, are phthalic acid; alkyl ($C_4$–$C_9$) phthalic acid; tetrahalogenated phthalic acid; 2,3-naphthalenedicarboxylic acid; alkyl ($C_4$–$C_9$)-2,3-naphthalenedicarboxylic acid; 5,6,7,8-tetrahydro-2,3-naphthalenedicarboxylic acid; 5,6,7,8-tetrahalogenated 2,3-naphthalenedicarboxylic acid; 1,2-naphthalenedicarboxylic acid; alkyl ($C_4$–$C_9$)-1,2-naphthalenedicarboxylic acid; naphthalic acid; alklyl ($C_4$–$C_9$) naphthalic acid, 4,5-dihalogenated naphthalic acid; and the like, etc.; and acid anhydrides of such acids.

The metal complexes of the present invention can be prepared by a known process. The process for their preparation, therefore, will be described briefly.

The aromatic dicarboxylic acid contemplated is dispersed in a compatible vehicle such as water or dissolved in a compatible solvent such as methanol, ethanol, ethyl cellosolve or the like, and a metal imparting agent is admixed with the dispersion or solution in a mole ratio of substantially about one mole of the agent, i.e. one gram atom of the metal, per two moles of the acid. The mixture is then heated, a pH adjusting agent is added to the mixture for the adjustment of pH thereof, and the reaction mixture is maintained at about 100° C. for several hours. The resulting reaction mixture, when in the form of a slurry, is filtered to separate the desired product. When the resulting reaction mixture is a solution, the mixture is diluted with water containing a mineral acid to form a precipitate, which is filtered off.

It is believed that, according to the present invention, the product thus obtained will be represented by the formula

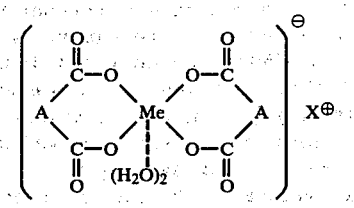

(I)

wherein A is an aromatic moiety which corresponds to the dicarboxylic acid contemplated, and which may optionally contain one or more substituents thereon, Me is Cr, Co or Fe, and X is a counter ion.

The particular counter ion or cation in this regard can be changed according to the conditions of te after-treatment of the product. For example, when the reaction mixture or precipitate before filtration is adjusted to a pH of up to 4, such as by treatment with a dilute mineral acid such as hydrochloric acid, and the product which is then filtered off is washed until the pH thereof becomes about 6 to 7, the counter ion is the hydrogen ion. If the product is adjusted to a pH of about 9 to 10 with an alkali, such as an inorganic base, e.g. an aqueous solution of an alkali metal hydroxide such as caustic soda, the counter ion is the corresponding basic cation, e.g. the alkali metal ion such as the sodium ion.

Furthermore, when the product is treated with hydrochlorides of amines, various corresponding ammonium salts are obtained.

Cr compounds, Co compounds and Fe compounds are usable as metal imparting agents according to the present invention. While complexes of such metal compounds are similar in charge controlling ability, according to the present invention, Fe complexes are slightly colored unlike the other complexes.

It will be appreciated that whereas various dicarboxylic acids are usable for producing the instant metal complex compounds in view of the compatibility of the resultant product with the toner resin, such acids can be used in admixture, i.e. mixtures of different aromatic dicarboxylic acids may be reacted with the particular metal imparting agent, in which case a mixture of symmetric and asymmetric aromatic moiety containing metal complexes having complicated e.g. complex or varied, desirable properties can be obtained.

The toners contemplated by the present invention comprise the instant metal-containing complex compound, a known resin for toners and a coloring agent. According to the present invention, these toners are prepared by admixing the instant metal-containing complex compound and a coloring agent with a known resin for toners.

Examples of useful resins in this regard are polystyrene, poly-P-chlorostyrene, polyvinyltuolene and like homopolymers of styrene and substituted styrene, styrene-P-chlorostyrene copolymer, styrene-propylene copolymer, styrene-vinyltoluene copolymer, styrene-vinylnaphthalene copolymer, styrene-methyl acrylate copolymer, styrene-ethyl acrylate copolymer, styrene-butyl acrylate copolymer, styrene-octyl acrylate copolymer, styrene-methyl methacrylate copolymer, styrene-ethyl methacrylate copolymer, styrene-butyl methacrylate copolymer, styrene-methyl chloromethyacrylate copolymer, styrene-acrylonitrile copolymer, styrene-vinyl methyl ether copolymer, styrene-vinyl ethyl ether copolymer, styrene-vinyl metyl ketone copolymer, styrenebutadiene copolymer, styrene isoprene copolymer, styreneacrylonitrile-indene copolymer and like styrene copolymers, polyvinyl chloride, polyvinyl acetate, polyethylene, polypropylene, silicone resin, polyester, polyurethane, polyamide, epoxy resin, polyvinyl butyral, rosin, modified rosin, terpene resin, phenolic resin, xylene resin, aliphatic or alicyclic hydrocarbon resins, aromatic petroleum resins, chlorinated paraffin, paraffin wax, etc. These resins may be used singly or in admixture.

Although various known dyes and pigments are usable as coloring agents, according to the present invention, especially useful for color copy toners are Benzidine Yellow, quinacridone, copper phthalocyanine, etc.

When the improved thermal stability of the instant metal complex is to be taken advantage of for the preparation of a toner by kneading such compound with the corresponding toner resin in a molten state at a higher temperature than is normally used or than has been heretofore used, it has been found according to the present invention that it is preferable first to knead fully the instant metal complex compound with the resin, and thereafter to dissolve or disperse any contemplated coloring agent in the mixture but at a reduced temperature in view of the degree of heat resistance of the coloring agent, or alternatively, to prepare a highly concentrated homogeneous mixture of the resin and the instant metal complex compound, then pulverize the mixture and thereafter admix the resulting pulverized powder with a premix of the remaining ingredients, whereby the melt kneading temperature in the ensuing kneading operation can be lowered to obtain a homogeneous toner of distinct color, all without impairing the desired properties of the coloring agent or of the final toner sought.

When toners of the present invention were tested in comparison with a known toner containing BONTRON E-81 (a commercial Cr complex compound of 3,5-ditertiary butylsalicylic acid; product of Orient Chemical Industries Ltd., Japan), the toners of the present invention were advantageously found to have outstanding durability due to improved compatibility of the complexes of the present invention with the resin component, and which was not the case with such known toner.

Stated more specifically, the corresponding conventional toner and toners of the present invention were tested for durability by placing each specimen into a 2-liter ball mill pot, driving the pot at a speed of about 50 r.p.m. and determining the amount of triboelectric charges on the specimen and the V-D characteristics thereof with the lapse of time. Consequently, all the specimens of the present invention were found to be much more stable in the amount of triboelectric charges and V-D characteristics than the conventional specimen as well as highly resistant to mechanical agitation. This reveals or confirms that the toners of the present invention are very durable and serviceable for a prolonged period of time.

Accordingly, to the present invention, therefore, toners having high durability can be prepared with use of various resins together with the instant metal-containing complex compound. Additionally, the instant metal complex, which serves as an essential component of the toners of the present invention, has an outstanding advantage in that it is colorless or substantially colorless, and therefore may be used efficiently as a charge control agent with the coloring agent also present.

For the preparation of toners, the metal complexes of the present invention, e.g. per formula (I) above, are used usually in an amount of substantially between about 0.1 to 10 parts by weight, preferably substantially between about 0.5 to 5 parts by weight, per 100 parts by weight of resin.

The resultant toner of the present invention is advantageously admixed with a carrier in the usual way to provide a developer. Any of the known carriers is usable for this purpose. Examples of useful carriers in this regard are magnetic particles, such as iron particles, glass beads, and such particles or beads coated with a resin.

The present invention will be described with reference to the following examples set forth by way of illustration and not limitation and in which the parts are all by weight unless otherwise specifically indicated:

EXAMPLE 1

Preparation of Cr complex of phthalic acid

A 95 g quantity of 40% aqueous solution of $Cr_2(SO_4)$ was added to 1000 g of water, and 66.4 g of phthalic acid (prepared by hydrolyzing phthalic anhydride and adding an acid to form a precipitate) was added to the solution. The resulting dispersion was heated to 95° C. and a solution of 24 g of caustic soda in 200 g of water was added dropwise to the dispersion over a period of 60 minutes. The mixture was thereafter stirred at 95 to 97° for 3 hours. The resulting reaction mixture was in the form of a slightly bluish green slurry and had a pH of 3.2. The mixture was cooled to 50° C. and then filtered. The product obtained upon filtering was washed with water until the pH thereof became about 6 to 7 and then dried to give 68 g of Cr complex compound of phthalic acid (hereinafter referred to as "Complex Compound 1").

To provide a comparison of the thermal stability of the product so obtained, such Complex Compound 1 and commercial charge control agents, i.e. a metal-containing complex dye "VALIFAST Black #3804"(product of Orient Chemical Industries Ltd., C.I. Acid Black 63) and said "BONTRON E-81"(Cr complex compound of 3,5-ditertiary butylsalicylic acid; product of Orient Chemical Industries Ltd., Japan), were heated on a hot plate and checked for changes. Complex Compound 1 was found to remain stable only with a slight color change (tested at temperatures of below 350° C.). In constrast, the metal-containing complex dye "VALIFAST Black #3804" ignited at about 330° C. In this latter regard, although the changes in the course of heating were not apparent because the last mentioned dye had a black powdery appearance, such dye was found to have been decomposed when after the heating test it was dissolved in a solvent. As to BONTRON E-81, this charge control agent evolved a gas in the meantime, i.e. during the heating test, gradually changed in color and ignited at about 340° C. Of course, no such ignition occurred at any said temperature during the heating test in the case of instant Complex Compound 1.

Subsequently, a toner was prepared in the following manner with use of Complex Compound 1.

| | |
|---|---|
| Styrene-butyl methacrylate copolymer ("HIMER SBM 73", product of Sanyo Kasei Co., Ltd.) (Resin component) | 100 parts |
| Carbon black ("Regal 300R", product of Cabot Corp.) (Coloring Agent component) | 5 parts |
| Complex Compound 1 (Charge Control Agent component) | 1 part. |

These ingredients were uniformly premixed by a ball mill to obtain a premix, which was then kneaded with hot rolls, cooled, thereafter coarsely ground by a continuous vibrating mill and further pulverized by a jet mill. The particles were classified to obtain a fraction comprising a powdery toner 3 to 15 microns in mean particle size. Five parts of the toner and 95 parts of iron carrier particles were mixed together to prepare a developer. The toner was found to be triboelectrically chargeable to an initial value of $-12.3\ \mu c/g$. Even after making 50,000 electrostatic copies continuously in the usual manner, the developer was still usable without entailing any reduction in the quality of the copies.

EXAMPLE 2

Preparation of Cr complex of naphthalic acid

A 86.5 g quantity of naphthalic acid (i.e., 1,8-naphthalic acid or 1,8-naphthalene dicarboxylic acid) was dissolved in 300 g of ethyl cellosolve, and chromium acetate (0.2 equivalent calculated as atomic weight of Cr) and 30 g of urea were added to the solution. The mixture was stirred at 100° to 115° C. for 2 hours. The reaction mixture was in the form of a bluish green supernatent liquid. The mixture was cooled to 30° C. and placed into 1 liter of water containing 60 g of 35% hydrochloric acid, whereby a pale bluish green precipitate was formed. The precipitate was filtered off and washed with water until the pH thereof became 6 to 7. The precipitate was dried to give 95 g of Cr complex compound of 1,8-naphthalic acid (hereinafter referred to as "Complex Compound 2"). Complex Compound 2 was found to have good thermal stability (as tested at temperatures of below 350° C. in the same manner as described in Example 1).

Subsequently, a toner was prepared in the following manner with use of Complex Compound 2.

| | |
|---|---|
| Epoxy resin ("Epon 1004", product of Shell Chemical Co.) (Resin component) | 100 parts |
| Copper phthalocyanine (Coloring Agent component) | 4 parts |
| Complex Compound 2 (Charge Control Agent component) | 1 part. |

A blue toner was prepared from the above ingredients in the same manner as in Example 1. The amount of triboelectric charges on the toner was −11.2 μc/g. Even after making 50,000 electrostatic copies, the toner was usable in the developer without entailing any reduction in the quality of the copies.

EXAMPLE 3

Preparation of Cr complex of tetrachlorophthalic acid

A 20 g quantity of sodium hydroxide was dissolved in 1000 g of water, and 200 g of ethylene glycol was added to the solution. Subsequently, 143 g of tetrachlorophthalic anhydride was added to the mixture, and the resulting mixture was heated to 95° to 98° C. to obtain a solution. A 122.5 g quantity of 40% aqueous solution of $Cr_2(SO_4)_3$ was diluted with 200 g of water and then added dropwise to the obtained solution at the same temperature, over a period of 40 minutes. The resulting mixture was thereafter stirred for 20 minutes, and provided a grayish green precipitate. Subsequently, 10% aqueous solution of sodium hydroxide was added dropwise to the reaction mixture to adjust the pH thereof to about 3. About 13 g of sodium hydroxide was so used. The mixture was further stirred for 2 hours, then cooled and filtered at about 50° C. The resulting reaction product was washed with water and dried, giving 140 g of Cr complex compound of tetrachlorophthalic acid. This complex compound was found to have good thermal stability (as tested at temperatures of below 350° C. in the same manner as described in Example 1).

EXAMPLE 4

Preparation of Co complex of phthalic acid

A 47.6 g of quantity of $CoCl_2.6H_2O$ was dissolved in 1000 g of water, 66.4 g of phthalic acid was added to the solution and the resulting dispersion was heated to 95° C. Subsequently, 60 g of 35% ammonia water was diluted with 200 g of water and added dropwise to the dispersion over a period of 60 minutes. The resulting mixture was thereafter stirred at 95° to 97° C. for 3 hours, giving a pale purple product. When the reaction mixture was adjusted to a pH of 4 with a mineral acid, as in Example 2, a slightly rose-colored precipitate was formed. The reaction mixture was cooled to room temperature and then filtered. The resulting reaction product was wahsed with water and dried, giving 60 g of a slightly purple complex, i.e. Co complex compound of phthalic acid. The complex changed to a bluish purple color when heated. This appears to be attributable to the removal of coordinated solvent water present in the complex compound. This complex compound was found to have good thermal stability (as tested at temperatures of below 350° C. in the same manner as in Example 1).

EXAMPLE 5

Preparation of Fe complex of phthalic acid

The procedure of Example 1 was repeated with the exception of using 54 g of ferric chloride (hexahydrate) in place of the chromium compound, in this case giving 70 g of a brown complex compound, i.e., Fe complex compound of phthalic acid, which was found to have good thermal stability (as tested at temperatures of below 350° C. in the same manner as described in Example 1).

EXAMPLE 6

Before the preparation of a corresponding toner, a highly concentrated homogeneous mixture was prepared in the following manner.

| | |
|---|---|
| Styrene-butyl methacrylate copolymer ("HIMER SBM 73", product of Sanyo Kasei Co., Ltd.) | 100 parts |
| Complex Compound 1 | 10 parts |

The above two ingredients were uniformly premixed by a ball mill, then kneaded in a kneader at 180° to 190° C. for 4 hours and cooled. The mixture was then pulverized.

A toner was then prepared in the following manner with the use of the pulverized highly concentrated homogeneous mixture thus obtained.

| | |
|---|---|
| Above homogeneous mixture | 11 parts |
| Styrene-butyl methacrylate copolymer | 90 parts |
| Benzidine Yellow | 3 parts. |

These three ingredients were uniformly premixed by a ball mill, then kneaded with hot rolls at a relatively low temperature (140°-150° C.), cooled, thereafter coarsely ground by a continuous vibrating mill and further pulverized by a jet mill. The particles were classified to obtain a fraction of yellow toner 3 to 15 microns in mean particle size.

Five parts of the toner and 95 parts of iron carrier particles were mixed together to prepare a developer. The toner was found to be triboelectrically chargeable to an initial value of −11.7 μc/g. Even after making 50,000 electrostatic copies continuously in the usual manner, the developer still afforded sharp yellow images without entailing any reduction in the quality of the copies.

COMPARISON EXAMPLE 1

A toner was prepared in the following manner.

| | |
|---|---|
| Styrene-butyl methacrylate copolymer ("HIMER SBM 73", product of Sanyo Kasei Co., Ltd.) | 100 parts |
| Benzidine Yellow | 3 parts |
| Complex Compound 1 | 1 part. |

These three ingredients were uniformly premixed by a ball mill and then kneaded in a kneader at 180° C. for 4 hours. The mixture was cooled, thereafter coarsely ground by a continuous vibrating mill and further pulverized by a jet mill to obtain a fraction of yellow toner 3 to 15 microns in mean particle size. Five parts of the toner and 95 parts of iron carrier particles were mixed together to prepare a developer. The toner was found to be triboelectrically chargeable to an initial value of −9.5 μc/g and afforded dull yellow copy images as compared to the sharp yellow images obtained in Example 6.

COMPARISON EXAMPLE 2

A toner was prepared in the same manner as in Example 1 but without using Complex Compound 1. A developer was prepared with the use of the resulting toner containing only the resin component and the coloring agent component, and tested similarly. The toner in the developer was (i.e. in the absence of the complex compound according to the present invention) was found to be triboelectrically chargeable to an initial value of 0.5 μc/g and afforded foggy copy images without any reproduction of thin lines even in the initial stage of the electrostatic copying operation.

COMPARISON EXAMPLE 3

A toner was prepared in the same manner as in Example 1 except that the metal-containing complex dye "VALIFAST Black #3804" (product of Orient Chemical Industries Ltd., C.I. Acid Black 63) was used in place of Complex Compound 1. A developer was prepared with the use of this toner and then tested similarly. Although copies of the same quality as in Example 1 were obtained initially, the developer produced undesirable changes resulting in a reduction in the quality of the images after making 50,000 electrostatic copies continuously. Thus, the later obtained copies were inferior to those obtained in Example 1 according to the present invention.

The following further illustrative and nonlimitative examples are set forth:

EXAMPLES 7(a) TO (f)

The procedures of Examples 1 to 5 are repeated in analogous manner with the appropriate metal imparting agent compounds and unsubstituted or nuclear substituted aromatic dicarboxylic acids capable of forming the corresponding anhydride, i.e. other than those combinations used to form the metal complex compounds of Examples 1 to 5, so as to provide each of the respective Cr, Co and Fe metal complex compounds of the following unsubstituted or nuclear substituted, as the case may be, phthalic acids and 2,3-, 1,2- and 1,8-napthalene dicarboxylic acids, respectively, all of which possess similar high thermal stability, charge controlling, substantially colorless and other properties and attributes to those of the metal complex compounds obtained in Examples 1 to 5:

(a) each halogenated phthalic acid, respectively,
(b) each alkyl ($C_4$–$C_9$) phthalic acid, respectively,
(c) 2,3-, 1,2- and 1,8-naphthalene dicarboxylic acid, respectively,
(d) 5,6,7,8-tetrahydro-, 2,3-, 1,2- and 1,8-naphthalene dicarboxylic acid, respectively,
(e) each halogenated, 2,3-, 1,2- and 1,8- naphthalene dicarboxylic acid, respectively,
(f) each alkyl ($C_4$–$C_9$), 2,3-, 1,2- and 1,8-naphthalene dicarboxylic acid, respectively.

Thus, advantageously, the present invention broadly provides a toner for developing electrostatic images, comprising a metal complex, e.g. a metal complex selected from the group consisting of a Cr complex, a Co complex and an Fe complex, of an aromatic dicarboxylic acid of the type which is capable of forming its corresponding acid anhydride, and optionally such a metal complex which is a metal complex of a substituted said aromatic dicarboxylic acid.

Preferably, the toner contains a toner resin and the metal complex is present in an amount of substantially between about 0.5 to 5 parts by weight per 100 parts by weight of the toner resin.

Advantageously, the present invention also broadly provides a charge control agent of high thermal stability, e.g. at temperatures up to but below about 350° C., i.e. thermally stable up to at least about 330° C. or 340° C., for a toner for developing electrostatic images, comprising a metal complex of a metal selected from group consisting of Cr, Co and Fe and substantially two molar equivalents of an aromatic dicarboxylic acid of the type which is capable of forming its corresponding acid anhydride, e.g. where the two carboxylic acid groups are in vicinal or side by side nuclear positions on the corresponding aromatic moiety, such aromatic moiety having from 6 to 10 nuclear carbon atoms.

Optionally, the aromatic dicarboxylic acid is substituted with at least one nuclear substitutent selected from the group consisting of halo, such as cholo, bromo, iodo and fluoro, and alkyl having 4 to 9 carbon atoms, such as straight and branched chain butyl, pentyl, heptyl, hexyl, octyl and nonyl. More particularly, the aromatic dicarboxylic acid may be phthalic acid, halo substited, e.g. chloro substituted, phthalic acid, or a naphthalene dicarboxylic acid such as 2,3-, 1,2- or 1,8- naphthalene dicarboxylic acid.

Such charge control agent, in this regard, may be favorably provided in the form of a toner composition containing a toner resin and a coloring agent together therewith in finely divided intimately intermixed form. In particular, the charge control agent may be present in a charge control effective amount of substantially between about 0.1 to 10 parts by weight per 100 parts of toner resin. Moreover, the toner composition is desirably admixed with a finely divided carrier therefor to provide a developer for developing electrostatic images.

Generally, therefore, the charge control agent may be in the form of a toner composition containing a toner resin for developing electrostatic images in admixture therewith, e.g. with the charge control agent being present in a charge control effective amount for controlling the, e.g. negative, charge of the toner resin. Of course, a coloring agent will normally also be present. Desirably, the charge control agent is present in the composition in a charge control effective amount of substantially between about 1 to 10 parts, and especially substantially between about 0.5 to 5 parts, by weight per 100 parts by weight of the corresponding toner resin present.

In accordance with a specific aspect of the present invention, a charge control agent for a toner for developing electrostatic images is contemplated, comprising a metal complex of a metal selected from the group consisting of Cr, Co and Fe, i.e. trivalent chromic, colbatic and ferric metal, and an aromatic dicarboxylic acid which is capable of forming its corresponding acid anhydride, e.g. where the two carboxylic acid groups are in vicinal or side by side nuclear positions on the corresponding aromatic moiety, and which has from 6 to 10 nuclear carbon atoms and is optionally substituted with at least one nuclear substituent selected from the group consisting of halo and alkyl having 4 to 9 carbon atoms, as aforesaid.

More specifically, said metal complex is substantially thermally stable at elevated temperatures below about 350° C., e.g. thermally stable up to at least about 340° C. or up to at least about 330° C., substantially colorless as well as capable of negatively charging toner resins for developing electrostatic images, and constitutes the reaction product in the presence of water, or of an aqueous reaction medium, of substantially one gram atom of said metal, in a corresponding metal imparting compound containing said metal, i.e. as metal imparting agent, with substantially two moles, or two corresponding molar equivalents per gram atom of such metal, of said aromatic dicarboxylic acid.

The resultant said reaction product will generally also contain on a corresponding equivalent basis substantially two moles or molecules of water, e.g. as coordinated solvent water, in the metal complex, as shown in formula (I) above, and the counter ion or cation of the metal complex may be selected from the group consisting of hydrogen and a basic salt cation such as an alkali cation, e.g. alkali metal cation such as sodium, or ammonium cation.

Where the corresponding aromatic dicarboxylic acid, in this regard, is substituted, it is preferably substituted with at least one halo nuclear substituent. In particular, the aromatic dicarboxylic acid is preferably phthalic acid, or halo, e.g. chloro, substituted phthalic acid, e.g. mono, di, tri or tetra halo substituted phthalic acid, including chloro, bromo, iodo and fluoro as the corresponding halo substituent or substituents, or alternatively is preferably a naphthalene dicarboxylic acid, and particularly is selected from the group consisting of 2,3-, 1,2- and 1,8- naphthalene dicarboxylic acid.

In accordance with respective preferred features of such specific aspect of the present invention, the aromatic dicarboxylic acid is phthalic acid and the metal is Cr or the metal is Co or the metal is Fe, as the case may be, or the aromatic dicarboxylic acid is tetrachlorophthalic acid and the metal is Cr, or alternatively the aromatic dicarboxylic acid is 1,8- naphthalene discarboxylic acid and the metal is Cr.

In the same way, in accordance with such specifi aspect of the present invention, the charge contrc agent or metal complex is provided in the form of toner composition containing a corresponding, e.g conventional, toner resin for developing electrostati images in admixture therewith, preferably with a corre sponding, e.g. conventional, coloring agent normall also being present therein, the charge control agent i particular being present in a charge control effectiv amount, e.g. of substantially between about 0.1 to 1 parts, and especially substantially between about 0.5 t 5 parts, by weight per 100 parts by weight of the tone resin, as aforesaid.

Furthermore, the present invention contemplates method of using a charge control agent of the foregoin type for preparing a toner for developing electrostatic images.

With regard to a first general embodiment of suc method, the charge control agent or metal complex i mechanically intermixed, e.g. by kneading, with a corresponding toner resin in molten state at elevated temperature, i.e. at an elevated temperature at which the resin is transformed to or which is sufficient to maintain the resin in molten state, in a first mixing step to provide an intimately intermixed premixture, cooling the premixture, pulverizing the cooled premixture, and thereafter mechanically intimately admixing, e.g. by kneading, therewith a coloring agent, which is thermally unstable or degradable or deterioratable at a given elevated temperature, in a second mixing step at a correspondingly lower elevated temperature than that used in the first mixing step and which is below the said given elevated temperature at which the coloring agent is thermally unstable.

Preferably, in such first general embodiment of such method, the first mixing step is carried out at an elevated temperature of about 180° to 190° C. and the second mixing step is carried out at an elevated temperature of about 140° to 150° C.

With regard to a second general embodiment of such method, the charge control agent or metal complex is mechanically intimately intermixed, e.g. by kneading, with a first portion of a corresponding such toner resin in molten state at elevated temperature, i.e. at such an elevated temperature at which the resin is transformed to or which is sufficient to maintain the resin in molten state, in a first mixing step to provide an intimately intermixed highly concentrated homogeneous premixture, cooling the premixture, pulverizing the cooled premixture, and thereafter mechanically intimately admixing, e.g. by kneading, therewith a further, or counterpart or remainder, portion of the toner resin and such a coloring agent, which is so thermally unstable or degradable or deterioratable at such a given elevated temperature, in a second mixing step at such a correspondingly lower temperature than that used in the first mixing step and which is below the said given elevated temperature at which the coloring agent is thermally unstable.

Here also, preferably, in such second general embodiment of such method, the first mixing step is carried out at an elevated temperature of about 180° to 190° C. and the second mixing step is carried out at an elevated temperature of about 140° to 150° C.

In all instances, the metal complex or complex compound or charge control agent, according to the present invention, possesses good compatibility under the circumstances with the toner resin component, is capable of negatively charging the corresponding toner without impairing the charging properties of the contemplated coloring agent component such as a metal-containing dye, and is thereby useful as a charge control agent for attaining toners having high durability and comprising chargeable particles of uniform quality. In particular, the instant metal complex or complex compound or charge control agent is not only distinguished by its substantially colorless property, but also distinguished more importantly by its improved or high thermal stability, e.g. at elevated temperatures up to but below about 350° C., i.e. thermally stable up to at least about 340° C. or up to at least about 330° C., whereby to permit its efficient mixing with a melt of the toner resin component, all without impairing its charge controlling performance or the charging properties of the conventional coloring agent component usable in association therewith such as a metal-containing dye.

While various specific embodiments of the invention have been shown and described in detail to illustrate the application of the principles and inherent features of the invention, it will be understood that the invention may be embodied otherwise without departing from such principles and inherent features.

What is claimed is:

1. A toner for developing electrostatic images comprising a metal complex of an aromatic dicarboxylic acid which such acid is capable of forming its corresponding acid anhydride, the metal complex being substantially thermally stable at elevated temperatures below about 350° C. and being represented by the formula

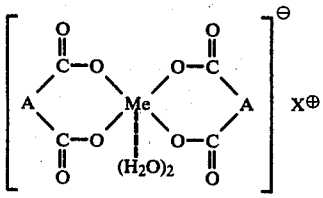

wherein A is an aromatic moiety which corresponds to the dicarboxylic acid contemplated, and which may optionally contain one or more substituents thereon, Me is Cr, Co or Fe, and X is a counter ion.

2. The toner according to claim 1, wherein the metal complex is a metal complex of a substituted aromatic dicarboxylic acid.

3. The toner according to claim 1, wherein the toner contains a toner resin and the metal complex is present in an amount of substantially between about 0.5 to 5 parts by weight per 100 parts by weight of the toner resin.

4. The toner according to claim 1, wherein X is a hydrogen or basic salt counter ion, and the toner contains a toner resin in admixture with the metal complex.

5. A charge control agent for a toner for developing electrostatic image comprising a metal complex of a metal selected from the group consisting of Cr, Co and Fe and substantially two molar equivalents of an aromatic dicarboxylic acid which is capable of forming its corresponding acid anhydride and having from 6 to 10 nuclear carbon atoms, the metal complex being substantially thermally stable at elevated temperatures below about 350° C.

6. The agent according to claim 5, wherein the aromatic dicarboxylic acid is substituted with at least one substituent selected from the group consisting of halo and alkyl having 4 to 9 carbon atoms.

7. The agent according to claim 5, wherein the aromatic dicarboxylic acid is phthalic acid.

8. The agent according to claim 5, wherein the aromatic dicarboxylic acid is halo substituted phthalic acid.

9. The agent according to claim 5, wherein the aromatic dicarboxylic acid is a naphthalene dicarboxylic acid.

10. The agent according to claim 5, in the form of a toner composition containing a toner resin and a coloring agent together therewith in finely divided intimately intermixed form.

11. The composition according to claim 10, wherein the charge control agent is present in a charge control effective amount of substantially between about 0.1 to 10 parts by weight per 100 parts of the toner resin.

12. The composition according to claim 10, wherein the toner composition is admixed with a finely divided carrier therefor to provide a developer for developing electrostatic images.

13. The agent according to claim 5, in the form of a toner composition containing a toner resin for developing electrostatic images in admixture therewith.

14. The composition according to claim 13, wherein the charge control agent is present in a charge control effective amount for controlling the charge of the toner resin.

15. The composition according to claim 14, wherein a coloring agent is also present therein.

16. The composition according to claim 13, wherein the charge control agent is present in a charge control effective amount of substantially between about 0.1 to 10 parts by weight per 100 parts of the toner resin.

17. The composition according to claim 15, wherein the charge control agent is present in a charge control effective amount of substantially between about 0.5 to 5 parts by weight per 100 parts of the toner resin.

18. A charge control agent for a toner for developing electrostatic images according to claim 5, comprising a metal complex of a metal selected from the group consisting of Cr, Co and Fe and an aromatic dicarboxylic acid which is capable of forming its corresponding acid anhydride and having from 6 to 10 nuclear carbon atoms and optionally substituted with at least one nuclear substituent selected from the group consisting of halo and alkyl having 4 to 9 carbon atoms, said metal complex being substantially thermally stable at elevated temperatures below about 350° C., substantially colorless as well as capable of negatively charging toner resins for developing electrostatic images, and constituting the reaction product in the presence of water of substantially one gram atom of said metal, in a corresponding compound containing said metal, with substantially two moles of said aromatic dicarboxylic acid.

19. The agent according to claim 18, wherein the aromatic dicarboxylic acid is substituted with at least one halo substituent.

20. The agent according to claim 18, wherein the aromatic dicarboxylic acid is phthalic acid.

21. The agent according to claim 18, wherein the aromatic dicarboxylic acid is halo substituted phthalic acid.

22. The agent according to claim 18, wherein the aromatic dicarboxylic acid is a naphthalene dicarboxylic acid.

23. The agent according to claim 18, wherein the aromatic dicarboxylic acid is selected from the group consisting of 2,3-, 1,2- and 1,8-naphthalene dicarboxylic acid.

24. The agent according to claim 18, wherein the aromatic dicarboxylic acid is phthalic acid and the metal is Cr.

25. The agent according to claim 18, wherein the aromatic dicarboxylic acid is phthalic acid and the metal is Co.

26. The agent according to claim 18, wherein the aromatic dicarboxylic acid is phthalic acid and the metal is Fe.

27. The agent according to claim 18, wherein the aromatic dicarboxylic acid is tetrachloro phthalic acid and the metal is Cr.

28. The agent according to claim 18, wherein the aromatic dicarboxylic acid is 1,8-napthalene dicarboxylic acid and the metal is Cr.

29. The agent according to claim 18, in the form of a toner composition containing a toner resin for developing electrostatic images in admixture therewith.

30. The composition according to claim 29, wherein a coloring agent is also present therein.

31. The composition according to claim 29, wherein the charge control agent is present in a charge control effective amount of substantially between about 0.1 to 10 parts by weight per 100 parts of the toner resin.

32. A method of using a charge control agent according to claim 18 for preparing a toner for developing electrostatic images, comprising mechanically intimately mixing the agent with a toner resin in molten state at elevated temperature in a first mixing step to provide an intimately intermixed premixture, cooling the premixture, pulverizing the cooled premixture, and thereafter mechanically intimately admixing therewith a coloring agent, which is thermally unstable at an elevated temperature, in a second mixing step at a correspondingly lower elevated temperature than that used in the first mixing step and which is below the elevated temperature at which the coloring agent is thermally unstable.

33. A method according to claim 32, wherein the first mixing step is carried out at an elevated temperature of about 180° to 190° C. and the second mixing step is carried out at an elevated temperature of about 140° to 150° C.

34. A method of using a charge control agent according to claim 18, for preparing a toner for developing electrostatic images, comprising mechanically intimately mixing the agent with a first portion of a toner resin in a molten state at elevated temperature in a first mixing step to provide an intimately intermixed highly concentrated homogeneous premixture, cooling the premixture, pulverizing the cooled premixture, and thereafter mechanically intimately admixing therewith a further portion of the toner resin and a coloring agent, which is thermally unstable at an elevated temperature, in a second mixing step at a correspondingly lower elevated temperature than that used in the first mixing step and which is below the elevated temperature at which the coloring agent is thermally unstable.

35. A method according to claim 34, wherein the first mixing step is carried out at an elevated temperature of about 180° to 190° C. and the second mixing step is carried out at an elevated temperature of about 140° to 150° C.

* * * * *

UNITED STATES PATENT OFFICE
CERTIFICATE OF CORRECTION

Patent No. 4,403,027 Dated Sep. 6, 1983

Inventor(s) Ishikawa et al

It is certified that error appears in the above-identified patent and that said Letters Patent are hereby corrected as shown below:

On first page of issued patent, where it says
"(75) Inventors: Kazuhiro Ishikawa, Nara; Yoji Kawagishi, Yawata; Yukihiko Ishida, Neyagawa, all of Japan"

please cancel the above and change it to the following to add the name and address of the fourth inventor:

(75) Inventors: Kazuhiro Ishikawa, Nara; Yoji Kawagishi, Yawata; Yukihiko Ishida, Neyagawa; Masahiro Otsuka, Osaka, all of Japan.

Signed and Sealed this

*Twenty-second* Day of *November 1983*

[SEAL]

*Attest:*

GERALD J. MOSSINGHOFF

*Attesting Officer*

*Commissioner of Patents and Trademarks*